US007980179B2

(12) United States Patent
Harbrecht et al.

(10) Patent No.: US 7,980,179 B2
(45) Date of Patent: Jul. 19, 2011

(54) SAFETY AND ARMING UNIT FOR A FUZE OF A PROJECTILE

(75) Inventors: Rudolf Harbrecht, Nürnberg (DE); Boris-Johannes Fürst, Bisingen (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 213 days.

(21) Appl. No.: 12/334,943

(22) Filed: Dec. 15, 2008

(65) Prior Publication Data

US 2009/0151585 A1 Jun. 18, 2009

(30) Foreign Application Priority Data

Dec. 15, 2007 (DE) ..... 10 2007 060 567

(51) Int. Cl.
*F42C 15/34* (2006.01)

(52) U.S. Cl. ..... 102/222

(58) Field of Classification Search ..... 102/216, 102/222, 246, 247, 253; 89/6, 6.5
See application file for complete search history.

(56) References Cited

U.S. PATENT DOCUMENTS

| | | | | | |
|---|---|---|---|---|---|
| 2,243,621 | A | * | 5/1941 | Denoix | 102/253 |
| 2,345,618 | A | * | 4/1944 | McCormick | 102/222 |
| 2,619,905 | A | * | 12/1952 | Apothéloz | 102/222 |
| 2,664,822 | A | * | 1/1954 | Hale | 102/231 |
| 2,949,855 | A | * | 8/1960 | Saunderson | 102/216 |
| 2,952,208 | A | * | 9/1960 | Wagoner | 102/216 |
| 3,086,468 | A | * | 4/1963 | Mountjoy et al. | 102/216 |
| 3,332,642 | A | | 7/1967 | Halling | |
| 3,515,071 | A | * | 6/1970 | Brackman | 137/798 |
| 3,580,176 | A | * | 5/1971 | Boswell | 102/222 |
| 3,814,018 | A | * | 6/1974 | Daniel | 102/253 |
| 3,839,963 | A | * | 10/1974 | Nathan et al. | 102/214 |
| 3,842,740 | A | * | 10/1974 | Mirlesse | 102/487 |
| 4,217,828 | A | * | 8/1980 | Pelousse | 102/249 |
| 4,856,733 | A | | 8/1989 | Lachmann | |
| 4,883,239 | A | | 11/1989 | Lachmann et al. | |
| 5,872,324 | A | * | 2/1999 | Watson et al. | 102/265 |
| 6,536,347 | B1 | * | 3/2003 | Zacharin | 102/274 |
| 7,437,995 | B2 | * | 10/2008 | Rastegar et al. | 102/216 |

FOREIGN PATENT DOCUMENTS

| | | |
|---|---|---|
| DE | 33 48 136 C2 | 8/1984 |
| DE | 37 16 606 C2 | 3/1989 |
| DE | 37 38 580 C2 | 6/1989 |
| EP | 1 826 527 A1 | 8/2007 |
| GB | 2 177 213 A | 1/1987 |

* cited by examiner

*Primary Examiner* — Bret Hayes
(74) *Attorney, Agent, or Firm* — Laurence A. Greenberg; Werner H. Stemer; Ralph E. Locher

(57) ABSTRACT

A safety and arming unit for a fuze of a projectile has a firing device for transferring the firing energy to another firing device and a barrier for interrupting the transfer. The barrier is locked in a locking state by a safety that triggers an unlocking action due to a physical arming parameter. The arming parameter of the novel device is an apogee parameter, effected by the projectile flying through the apogee of its projectile trajectory. A physical arming parameter independent of a launch parameter can be used to unlock the safety without needing to pull out a safety pin.

19 Claims, 5 Drawing Sheets

SAFETY AND ARMING UNIT FOR A FUZE OF A PROJECTILE

CROSS-REFERENCE TO RELATED APPLICATION

This application claims the priority, under 35 U.S.C. §119, of German application DE 10 2007 060 567.8, filed Dec. 15, 2007; the prior application is herewith incorporated by reference in its entirety.

BACKGROUND OF THE INVENTION

Field of the Invention

The invention relates to a safety and arming unit for a fuze of a projectile, comprising a firing means for transferring the firing energy to another firing means and a barrier for interrupting the transfer. The barrier is locked in a locking state by a safety means provided for an unlocking action due to a physical arming parameter.

A safety and arming unit for a fuze is used to prevent inadvertent activation of a main charge of a projectile; however, activating the main charge should be possible after arming. For this purpose, the safety and arming unit is a component of a fuze for firing the main charge and is provided with a firing chain of two or more firing means. In order to fire the main charge, the first firing means is firstly activated, for example by means of a puncture-sensitive mini-detonator which is punctured by a puncturing needle. Explosion energy of the first firing means is transferred to the second firing means by an appropriate arrangement of the first two firing means, where the second firing means may be designed as a firing booster. The latter can transfer its explosion energy to an initial charge or main charge.

Conventional fuzes, especially of simple projectiles such as mortar shells, have a safety pin as a first safety means and a device which detects the launch shock as a second safety means. The disadvantage of these safety means is that the safety pin needs to be pulled out manually before loading the mortar shell. It is fairly common to forget to pull out the safety pin. The result is that the mortar shell becomes a dud.

SUMMARY OF THE INVENTION

It is accordingly an object of the invention to provide a safety and arming device for the fuze of a projectile which overcomes the above-mentioned disadvantages of the heretofore-known devices and methods of this general type and which uses a physical arming parameter independent of a launch parameter to unlock the safety means without needing to pull out a safety pin.

With the foregoing and other objects in view there is provided, in accordance with the invention, a safety and arming unit for a fuze of a projectile, comprising:

a firing means disposed to transfer a firing energy thereof to another firing means;

a barrier for selectively interrupting the transfer of the firing energy; and a safety disposed to lock said barrier in a locking state and to unlock said barrier in dependence on a physical arming parameter in the form of an apogee parameter effected when the projectile flies through an apogee of a projectile trajectory.

In other words, the objects are achieved by a safety and arming unit of the type mentioned initially, in which the arming parameter is an apogee parameter, effected by the projectile flying through the apogee of a projectile trajectory.

A parameter (i.e., a criterion) is utilized by the invention which is independent of a launch parameter and which, in conjunction with using the launch parameter, can attain a high level of safety against inadvertent firing.

The invention is particularly suitable for projectiles in the form of mortar shells. Mortars are generally fired at an angle of >45° to the horizontal, as a result of which the profile of the trajectory is approximately characterized by a parabolic flight which has a prominent reversal point at the apogee. An effect of the reversal point on a projectile passing through the reversal point can be used as an apogee parameter.

The apogee parameter is a parameter which allows identification of the passage of the projectile through the apogee. Its use as an arming parameter expediently assumes sampling or otherwise evaluating the apogee parameter by the safety means so that flying through the apogee is identified at least implicitly. The apogee parameter can be a profile of a velocity or deceleration and/or rotation of the projectile or fuze about an axis which is transverse with respect to the flight direction. The rotation can be detected by inertia or other parameters, such as a direction of the magnetic field. The height profile of the fuze above a reference level such as the ground can also be an apogee parameter. Due to the fact that satisfying the apogee parameter indicates that the projectile is a long way from the launch tube, a high safe separation distance can be attained. Further arming parameters can be acceleration, angular momentum, a ram-air pressure, a time after launch or an impact pressure.

The barrier is used to absorb and/or deflect firing energy of the first firing means in such a manner that firing the second firing means due to the firing energy of the first firing means is reliably prevented. In addition to the safety means, provision is advantageously made for a second safety means which is independent of the first safety means and locks the barrier. The two safety means are expediently provided for an unlocking action on the basis of two physical arming parameters which are independent of one another. The safety means—expediently both safety means—serves or serve to in particular mechanically lock the barrier in such a way that, for example, movement of the barrier from its safe position to the armed position is reliably prevented. The barrier can be unblocked by an unlocking action of the corresponding safety means in such a way that it can be moved to the armed position, either independently due to inertia, for example, or driven by a moving means.

In one advantageous embodiment of the invention, the apogee parameter is a force. A force can easily be sampled and it is easy to identify whether the apogee parameter is satisfied.

The safety means can be designed to be robust and not susceptible to faults if provision is made for mechanical sampling of the apogee parameter.

The safety means expediently comprises a locking means which causes an unlocking action by changing its position in the fuze on passing through the apogee. The safety means can easily be produced in this manner. Equally advantageously, the locking means, in its safe position, advantageously mechanically blocks an unlocking action.

It is possible to sample the apogee parameter in a simple manner if provision is made for the locking means to change its position by means of its inertia. The locking means is advantageously a metal piece, in particular a heavy metal piece, which reacts particularly finely to acceleration due to its high relative density.

If, by changing its position, the locking means unblocks an unlocking space into which part of a lock can be inserted for effecting the unlocking action, then locking and unlocking can be achieved easily.

In a further embodiment of the invention, the safety means comprises a magnet which, by changing its position in the fuze, causes an unlocking action on passing through the apogee. A mechanical step in the unlocking action can be attained by a magnetically effected step, as a result of which an unlocking mechanism can be kept simple.

In order to avoid inadvertent and premature unlocking of the safety means, the safety means expediently requires previous unlocking depending on a different arming parameter before it is unlocked due to the apogee parameter being satisfied.

The reliability against inadvertent unlocking of the second safety means can additionally be increased by blocking the unlocking of the safety means by another safety means. For example, the safety means can only be unlocked following a previous unlocking action. For this purpose, the arming parameter is expediently effected by launching the projectile. Hence, the safety means can be unlocked only once the projectile has been launched.

A particularly reliable further safety means is a mechanical dual-bolt system which is unlocked by the launch acceleration.

It is possible to provide a reliably acting barrier if the barrier is a rotor and provision is made for the second safety means to lock the rotor.

The projectile reaches the apex of its trajectory at the apogee. Due to the design of a projectile, possibly additionally due to a rear control surface, the projectile changes its orientation at the apex and lowers the fuze downwards towards the earth. This change in direction can reliably be used as the apogee parameter.

If the safety means is arranged significantly in front of a point of rotation of the projectile which is caused, for example, by air drag, then slight lateral acceleration across the direction of flight of the projectile is effected by the change in direction. This lateral acceleration can be sensed mechanically or electronically as a feature of the change in direction and can be used as apogee parameter.

A further characteristic of the apex of the trajectory is the minimum velocity of a projectile fired steeply upwards. Since the projectile decelerates during its flight due to the air drag caused by the projectile, this deceleration is lowest at the minimum velocity. The minimum velocity is attained at the apex or, due to general deceleration of the projectile during flight, just afterwards, when the gravitational acceleration balances the general deceleration. If this acceleration minimum is detected, the minimum longitudinal acceleration component of the fuze about the apex can be used as the apogee parameter.

The velocity of the projectile can also be used as the apogee parameter if it is measured around the apogee by an evaluation means and the velocity minimum is identified. The evaluation means is expediently an electronic evaluation means.

An electrical or electronic sensor can in particular be advantageous for detecting and evaluating particularly small forces. Since its evaluation requires an electronic evaluation means, an appropriate evaluation means is already available when such a sensor is used and, in this case, it can also control the unlocking. The unlocking of the second safety means is expediently controlled electronically.

The direction of the Earth's magnetic field relative to a direction of the fuze can be measured, particularly when using an electronic evaluation means, and this can be used to deduce a change in the direction of the projectile. When the directional change per unit time reaches a maximum, then the projectile has reached the apogee or has just passed it. The direction of the Earth's magnetic field relative to a direction of a fuze and/or its change in direction can be reliably measured in this case and can be used as the apogee parameter, in particular by an appropriately prepared electronic evaluation means.

Other features which are considered as characteristic for the invention are set forth in the appended claims.

Although the invention is illustrated and described herein as embodied in safety and arming unit for a fuze of a projectile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
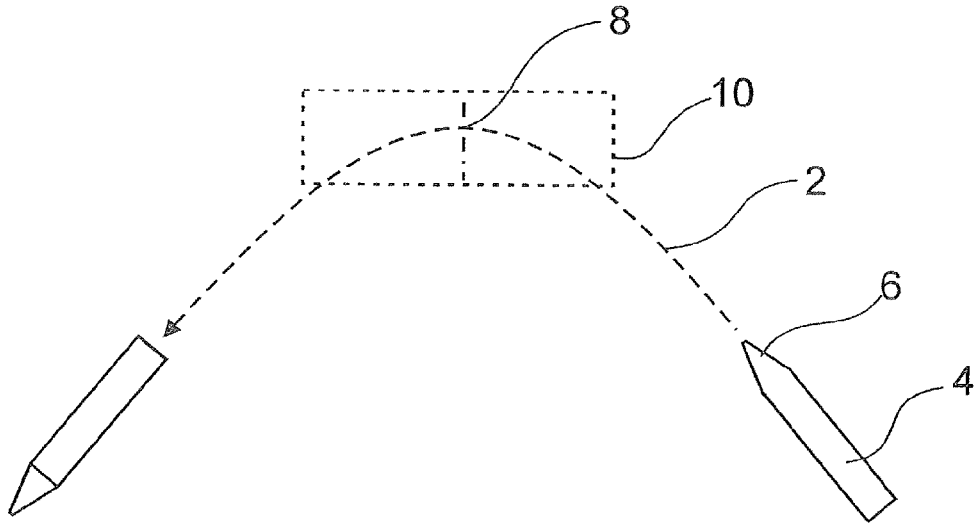
FIG. 1 is a schematic illustration of a trajectory of a projectile and an apogee.

Referring now to the figures of the drawing in detail and first, particularly, to FIG. 1 thereof, the apparatus according to the invention is illustrated as a projectile 4 with a fuze 6 that travels through a trajectory 2. After launching the projectile 4, it flies on a path which in ideal conditions is parabolic and deviates slightly from the parabolic path due to the friction drag of the air. While flying on a parabolic path, gravity acts equally on all elements of the projectile 4 so that all elements have the same acceleration towards the ground (i.e., Earth). Therefore, none of the elements are subject to any acceleration during flight in the reference system of the projectile 4 and they are therefore weightless.

Due to a steep launch angle of more than 45° relative to the Earth's surface or to the horizontal, for example approximately 50°, the projectile 4 passes through a prominent reversal point at the apogee 8 or apex of the trajectory 2, where the fuze 6 is displaced from an upwards-facing orientation to a downwards-facing orientation, effected by the shape of the projectile 4 and possibly assisted by a control surface. This change in direction accelerates the fuze 6 as a function of the position of the projectile 4 on its trajectory. This acceleration is greatest at the apogee 8. If the reversal point, or the curvature of the trajectory 2 at the apogee 8, is particularly prominent, for example due to a steep launch angle of more than 45° with respect to the Earth's surface, then the acceleration can be detected and evaluated well in a region 10 around the apogee 8.

Figure 2:
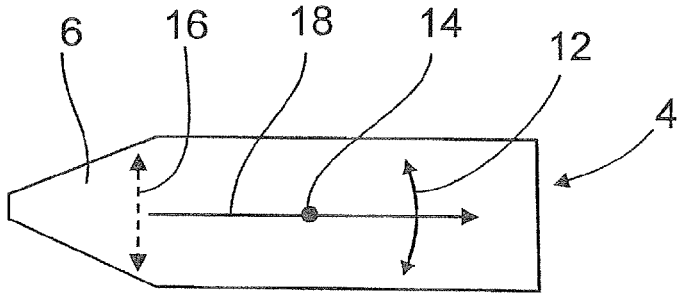
FIG. 2 is a schematic showing components of the acceleration in the projectile on reaching the apogee.

FIG. 2 illustrates the components of the acceleration which act on the projectile 4 and its elements during flight in addition to the gravitational acceleration. Due to the change in direction of the projectile 4 at the apogee 8, or in the region 10 around the apogee 8, the projectile 4 is rotated in a rotational direction 12 so that a lateral acceleration component 16 acts on the elements of the projectile 4 at a distance from a point of rotation 14 or a rotational axis; this acceleration acts in particular on the elements of the fuze 6, which is a long way from the point of rotation 14. Furthermore, the projectile 4 decelerates during its flight due to air drag, so that a longitudinal acceleration component 18 towards the rear acts on its elements.

Figure 3:
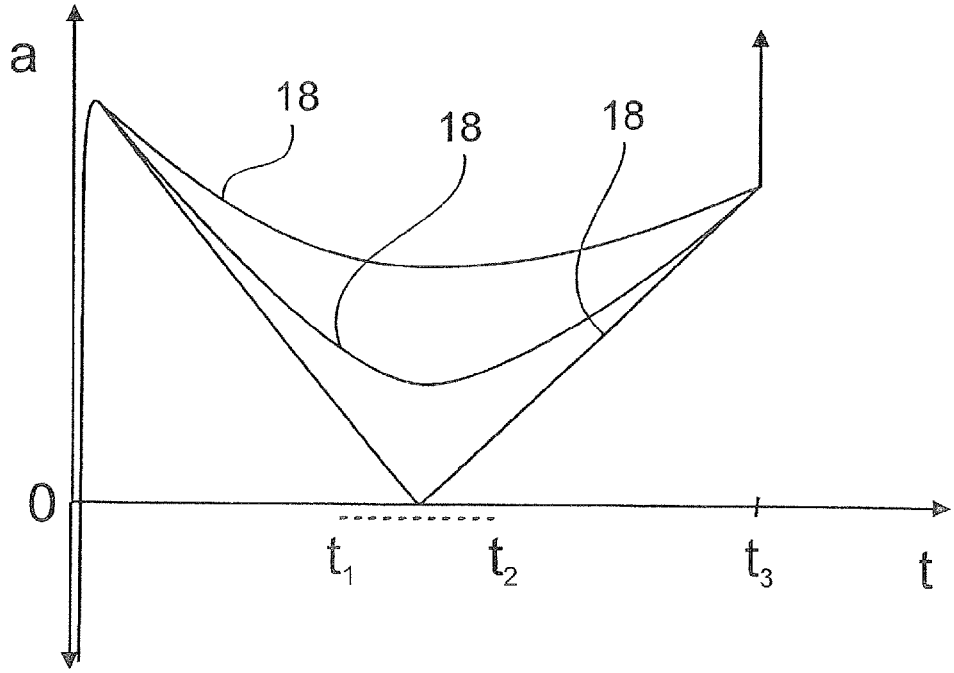
FIG. 3 is a diagram in which the longitudinal acceleration of the projectile is plotted against the time of flight.

The longitudinal acceleration component 18 is illustrated in FIG. 3 in the form of a diagram of the acceleration a plotted against the time of flight t. The acceleration a is directed towards the rear with respect to the projectile 4. When the projectile 4 is launched, very strong forward acceleration (indicated downwards in FIG. 3) acts on the projectile 4. Very shortly after leaving the launch tube, the projectile 4 decelerates, and the acceleration a plotted in FIG. 3 is positive and assumes a maximum value because the projectile 4 is at its maximum velocity at the beginning of its flight, and hence has its greatest air drag. Since the air drag is proportional to the velocity of the projectile 4, the curves illustrated in FIG. 3 also correspond to the velocity of the projectile 4.

The bottom-most curve represents the longitudinal acceleration component 18 during vertical flight in which the projectile 4 is stationary at the upper reversal point before descending. The middle curve is attained by a steep launch, for example of 50°, and the upper-most curve is attained by a flat launch. As the launch becomes steeper, the change in the acceleration becomes more pronounced at the apogee 8 or in the region 10, as illustrated in FIG. 3 by a dashed line representing the time period between times $t_1$ and $t_2$. The change of the acceleration is represented by the curvature of the curves in FIG. 3. At time $t_3$, the projectile 4 reaches the ground and is accelerated backwards in an extreme fashion by the impact; this is illustrated in FIG. 3 by the arrow pointing upwards.

Figure 4:
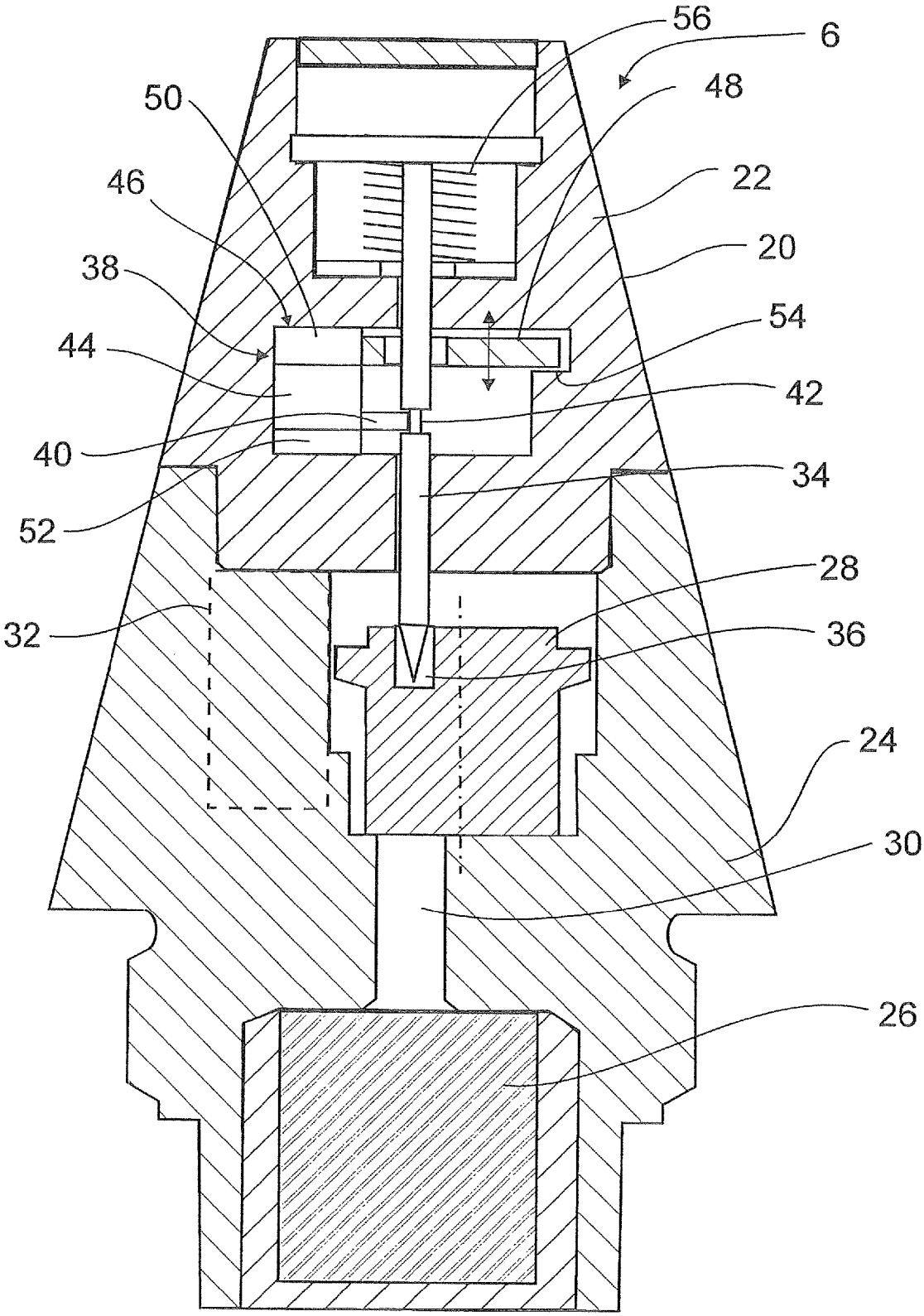
FIG. 4 is a section through a fuze with a safety means for sensing an apogee parameter according to the invention.
Figure 5:
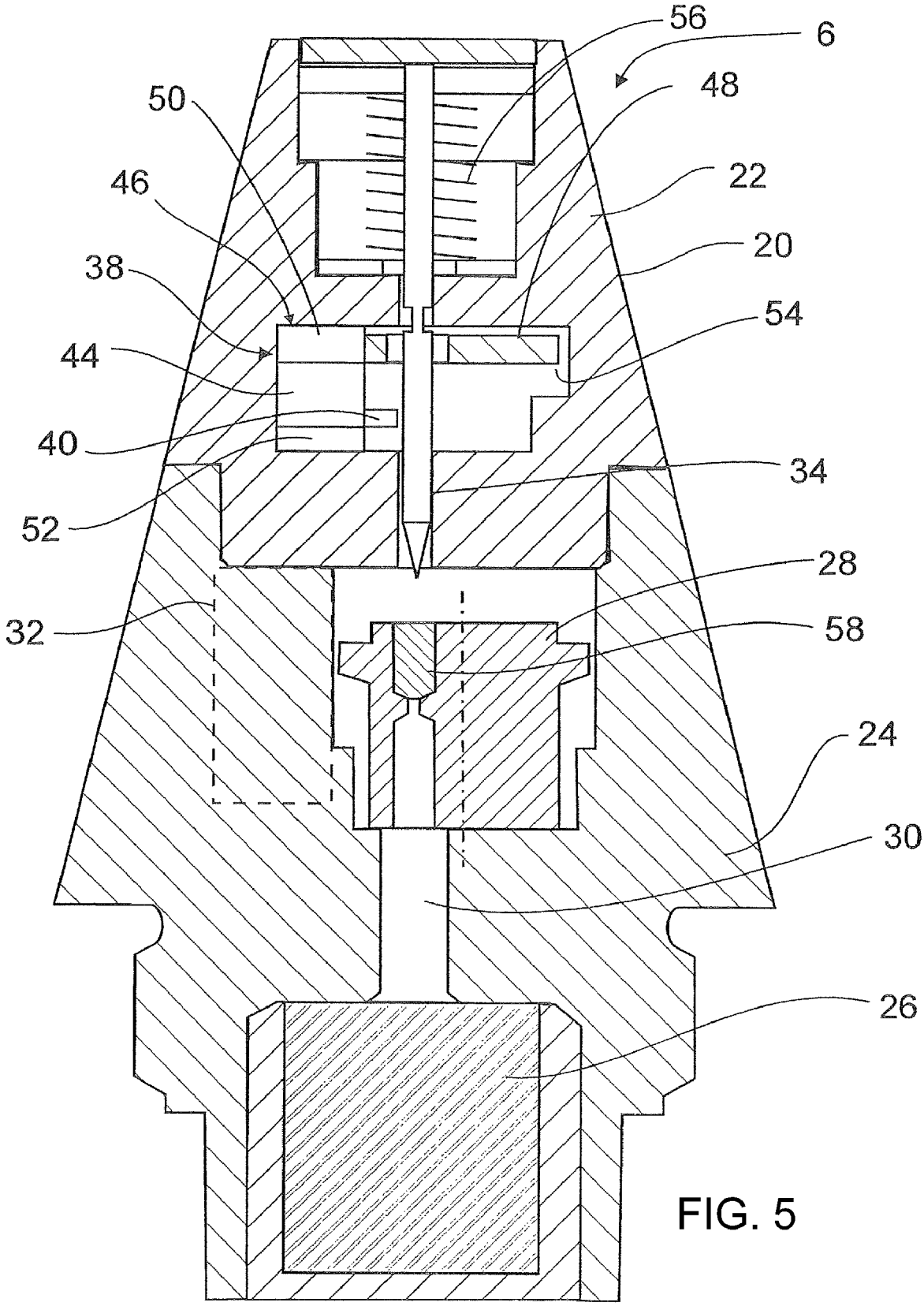
FIG. 5 is a similar view of the fuze according to FIG. 4 in an armed state.
Figure 6:
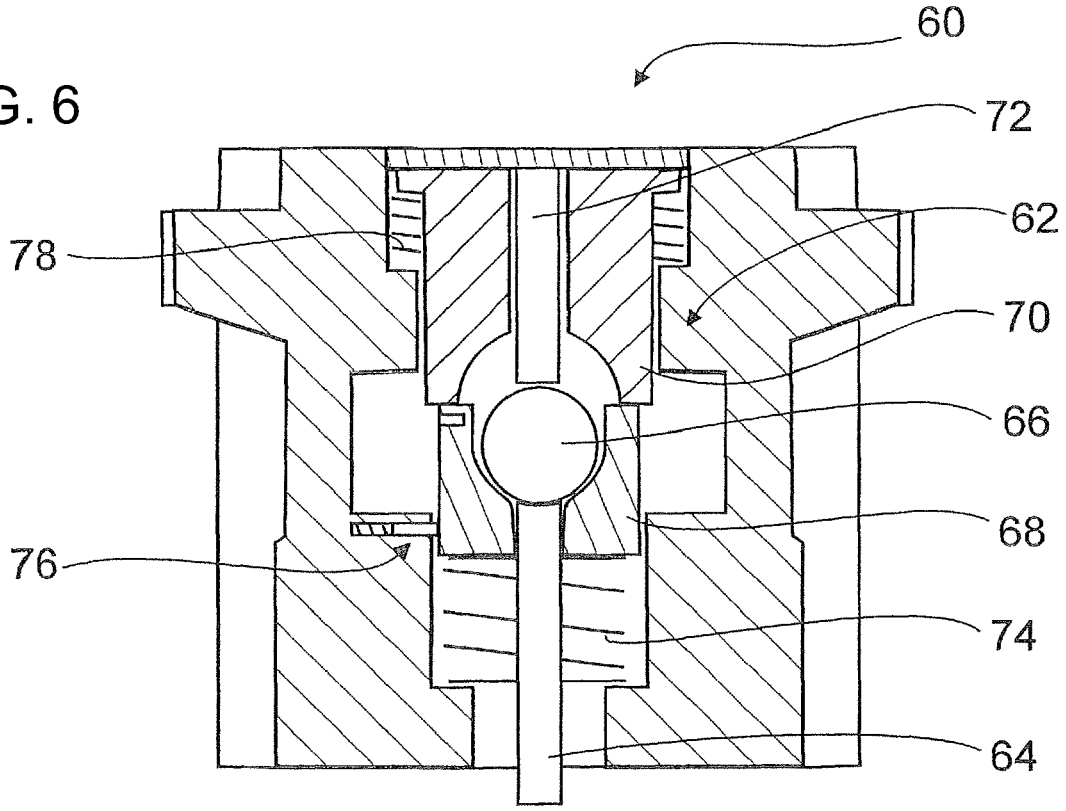
FIG. 6 is a section through a rotor of another fuze in a locked position.

FIG. 4 shows the fuze 6 in a simplified sectional view. The fuze 6 is in the form of an impact fuze. The fuze 6 comprises a housing 20 made of two parts 22, 24, the bottom part 24 of which is screwed into the body of the projectile 4 and has a stemming charge 26. This charge is fired by a firing means 58 which is illustrated in FIG. 5, arranged in a rotor 28, and the firing energy of which is transferred to the stemming charge 26 through a channel 30 when the rotor 28 is in an armed position.

FIG. 4 illustrates the rotor 28 in its secured position. It is kept in this position by a schematically indicated safety means 32, which is a dual-bolt system having two securing bolts and illustrated in detail and described in the commonly assigned European published patent application EP 1 826 527 A1, which is herewith incorporated by reference. This dual-bolt system holds the rotor 28 in its secured position. The lock is unlocked by the launch acceleration. The rotor 28 additionally remains locked in its secured position by a lock 34 which engages in an opening 36 in the rotor 28. The lock 34 is simultaneously the puncturing needle of the fuze 6. The lock 34 in turn is held in its secured position by a second safety means 38 which, with a locking means 40 in the form of a bolt, engages in a recess 42 of the lock 34.

The second safety means 38 furthermore comprises an evaluation means 44 and a sensor 46 having a probe 48 and a detection means 50. The probe 48 is a piece of elastic heavy metal which experiences a force, indicated by a double-headed arrow, because of a longitudinal acceleration component 18, and transfers it in an amplified manner to the detection means 50 due to appropriate mounting in the detection means 50. The force is detected by the detection means 50 and evaluated by the evaluation means 44 having an energy source 52 for this purpose which obtains its energy during flight from liquids which are mixed by the launch shock and then emit electrical energy for a short while. Since, during the launch, a very large force acts on the probe 48 in a downwards or backwards direction, a step 54 is incorporated in the part 22 at a short distance from the probe 48, by means of which the probe 48 can be supported during the launch shock. So as not to bend during the process, the probe 48 is designed to be sufficiently elastic to independently move away from the step 54 again after the launch shock and to be available for measuring the force.

The evaluation means 44 evaluates the profile of the force on the probe 48, searching for a minimum. This is based on the velocity minimum at the apogee 8, and minimum air drag associated with this. Noise in the profile, which can be generated by oscillations of the projectile 4 during flight, is suppressed or not evaluated by the evaluation means 44 in the process. Once the minimum is identified, the locking means 40 is pulled out of the recess 42 by a micro-motor. The safety means 38 is armed and the lock 34 is unblocked by means of this unlocking action, which is driven forwards by a spring 56, so that its tip is pulled out of the opening 36. The rotor 28 is now completely unlocked and is turned to its armed position, driven by a motor or a spring.

The armed position is illustrated in FIG. 5. The firing means 58 is aligned such that it lies in the puncture direction of the puncturing needle and is aligned with the channel 30 and the transfer charge 26. When the projectile 4 impacts, the puncturing needle is pushed backwards and punctures the firing means 58, which fires and releases firing energy which is incident on the stemming charge 26 and fires the latter. The stemming charge 26 in turn fires a main charge of the projectile 4.

In place of the probe 48, the sensor 46 can have a means for determining the angle between the direction of the Earth's magnetic field and a direction of the fuze 6. For this purpose, the sensor 46 may comprise a piece of magnetized or unmagnetized ferromagnetic metal, with force acting on it due to the Earth's magnetic field. The force and/or the direction of the force can be detected and evaluated as a variable linked to the angle. The evaluation means 44 is then primed for determining a maximum rate of change of the angle, and thus detects the apogee 8. The corresponding force, angle or the rate of change of the angle then forms the apogee parameter.

FIGS. 6 to 9 illustrate a different rotor 60 for a fuze which otherwise is not shown and which can be in the form of an impact fuze, such as fuze 6, or of a time fuze. The following description is substantially limited to the differences from the exemplary embodiment shown in FIGS. 4 and 5; reference is made to the latter with respect to the features and functions which remain the same. Components which substantially stay the same are in principle numbered with the same reference symbols.

The rotor 60 houses a safety means 62 which unblocks the rotor 60 in conjunction with another safety means 32. The other safety means 32 can be a dual-bolt system which locks the rotor 60. The safety means 62 comprises a lock 64 in the form of a bolt which engages in a corresponding recess in the second part 24 of the housing 20 and holds the rotor 60 locked in the housing 20, even after the other safety means 32 has been unlocked. The safety means 62 furthermore comprises a sphere as locking means 66 and two holding means 68, 70 which hold the sphere from two opposing sides.

The sphere is held loosely between the lock 64 and a further bolt 72, with there being a small amount of play between the sphere and the locks 64, 72 so that the sphere is not jammed in. It rests in a bowl-shaped recess in the holding means 68 (with a small amount of play there too) and is held in an easily movable fashion in its locked position by the interaction of the holding means 68 and locks 64, 72, with the locked position preventing outward movement of the lock 64 from the recess in the second part 24 of the housing 20.

Figure 7:
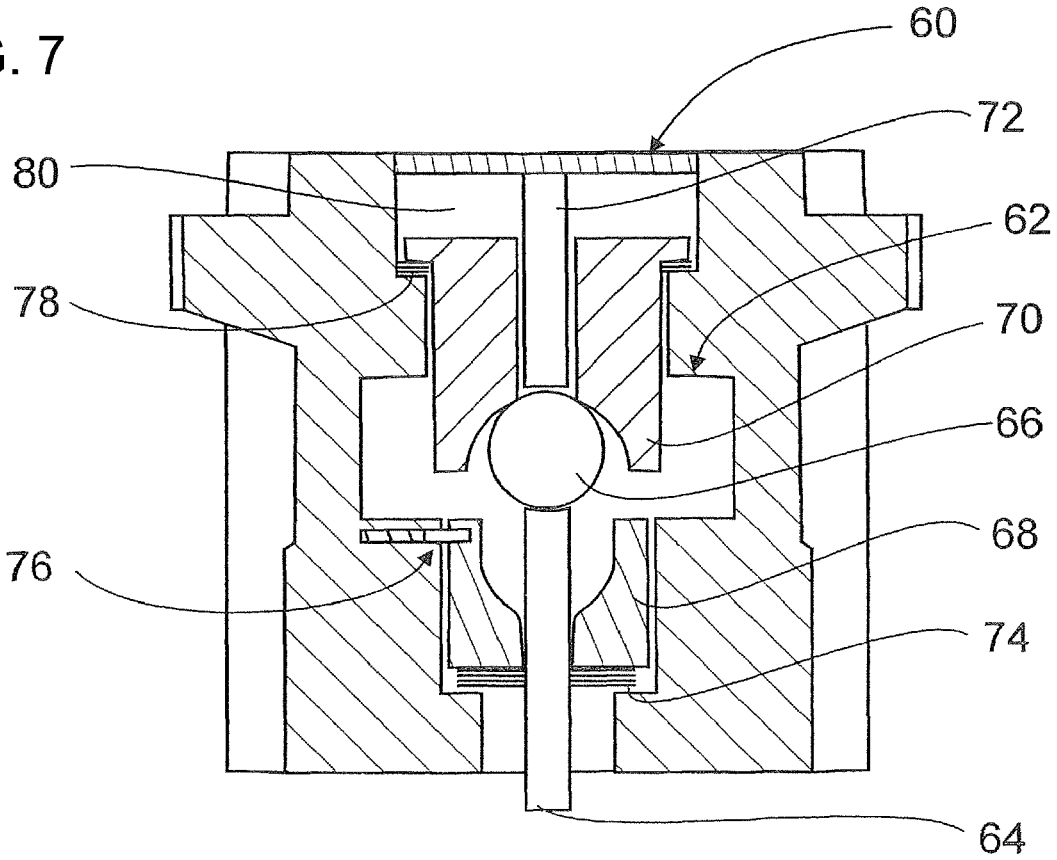
FIG. 7 is a section through the rotor according to FIG. 6 in a partly unlocked position.

FIG. 7 shows the rotor 60 during launch of the projectile 4. The other safety means 32 (not illustrated) is unlocked, and unblocks one lock of the rotor 60 which, however, remains held in its secured position due to the lock 64. The lower holding means 68 is also pushed downwards against a spring 74 by the launch shock and is locked there by means of a locking means 76 which engages in the holding means 68 and keeps it unlocked. At the same time, the other holding means 70 is pushed downwards against a spring 78 to a locked position so that the sphere is still held in its position, but now by a bowl-shaped recess in the second holding means 70.

Figure 8:
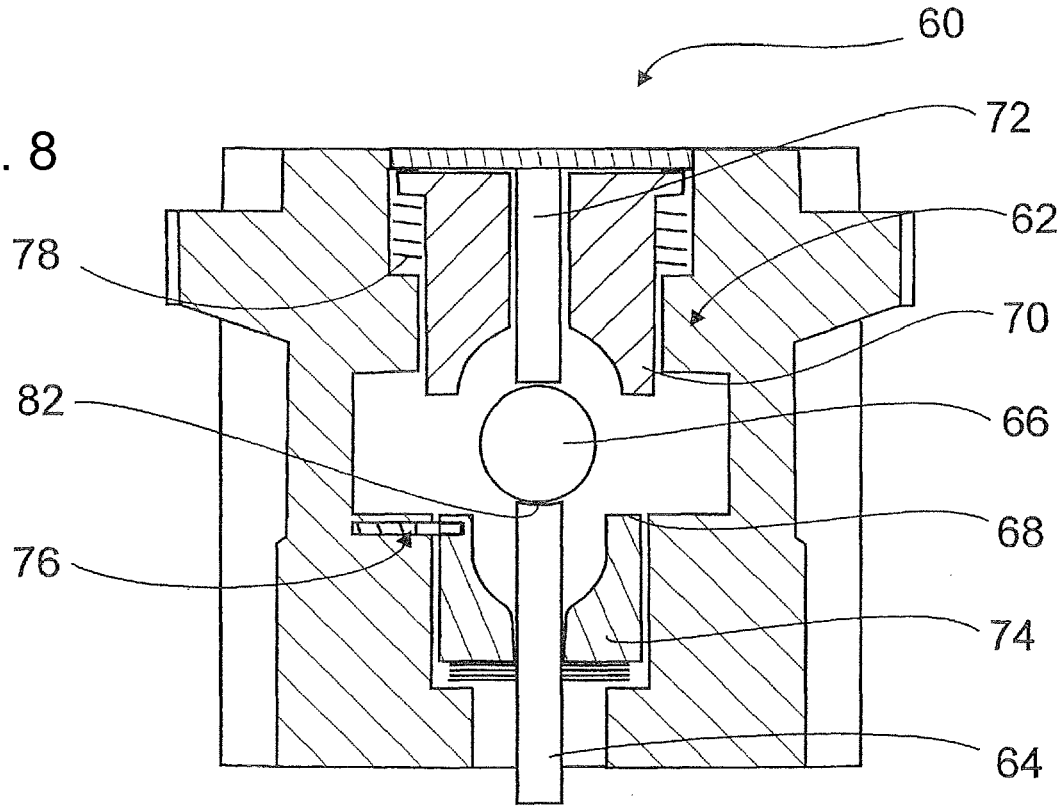
FIG. 8 is a section through the rotor according to FIG. 6 in a further unlocked position.

After the end of the launch acceleration of the fuze 6, the spring 78 pushes the upper holding means 70 upwards again, that is to say away from the sphere, so that the sphere is unblocked, as illustrated in FIG. 8. However, this process of the unblocking motion of the holding means 70 is time-delayed so that for a short while after launch the sphere is still held in the bowl-shaped recess of the holding means 70. The delay is effected by a relatively sealed air space 80, from which the trapped air can escape only slowly, so that the holding means 70 can only slowly return upwards to its initial position, for example over a period of a few seconds. The air inflow into the air space 80 during the launch shock is aided by the very high force by means of which the holding means 70 is pushed downwards against the spring 78 at that moment. In order to assist the process, provision can be made for a valve which lets the air easily enter air space 80, but prevents or slows down its escape.

In this manner, the sphere remains held in its holding position for a short time after launch so that any instabilities of the projectile 4 in flight which are still present for a short time after launch, do not unlock the sphere prematurely. The sphere is only released once the flight of the projectile 4 has been stabilized. This makes it possible to ensure a safe separation distance.

If the sphere is unblocked by both holding means 68, 70, as illustrated in FIG. 8, it nevertheless initially remains in its locked position. This is effected by a recess 82 in the lock 64 in which the sphere is mounted. By means of the deceleration, which is still high during the first part of the flight, the lock 64 is pushed upwards, that is to say forwards in the fuze 6, so that it pushes lightly against the sphere, and the recess 82 holds the sphere. Only once the deceleration has fallen to a minimum, either at the apogee 8 or in the region 10, depending on how pronounced the reversal point of the trajectory is, the light pressure fallen of the lock 64 on the sphere has become so small that the sphere can easily be deflected out of the recess 82.

Figure 9:
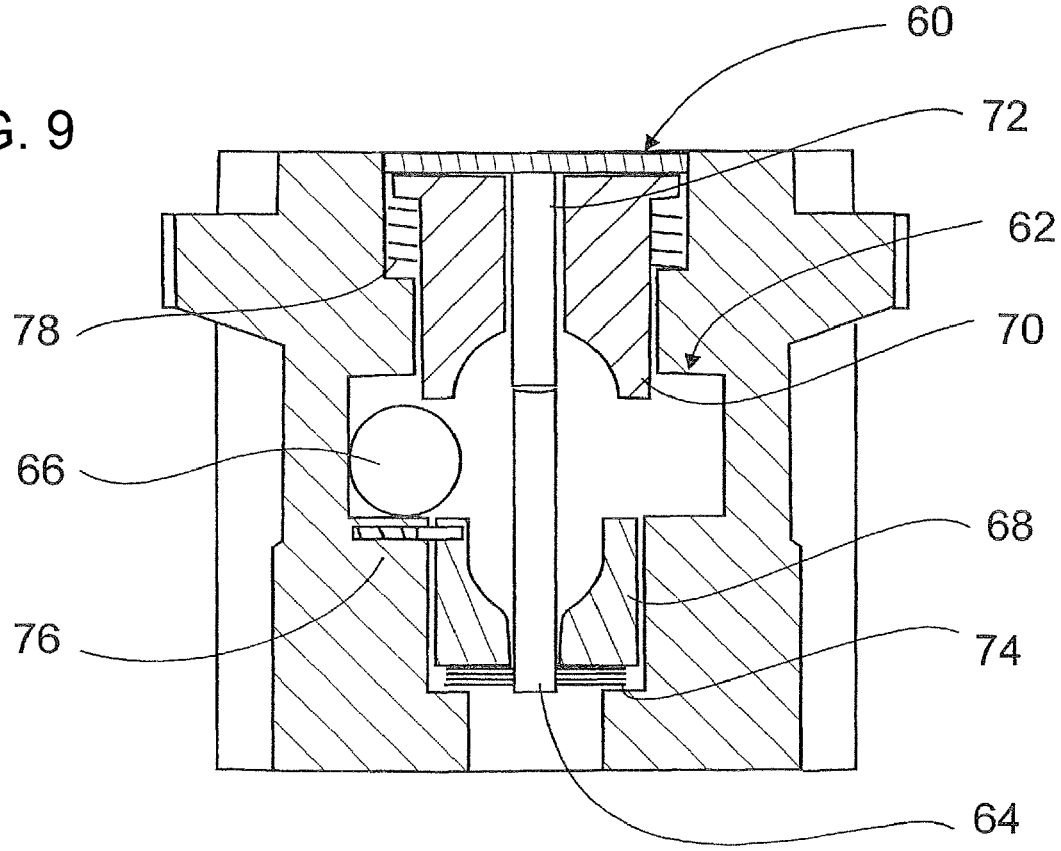
FIG. 9 is a section through the rotor according to FIG. 6 in a completely unlocked position.

At the apogee 8, or in the region 10, the lateral acceleration component 16 acts on the sphere and pushes it out of its locked position, as indicated in FIG. 9. The lock 64 is now unblocked so that it is pulled forwards out of its recess in the second part 24 of the housing 20 by increasing deceleration (slight assistance by a spring force is also feasible) and thus completely unlocks the rotor 60. The latter can now be moved into its unblocked position, driven by a motor or a spring, as is described, for example, with respect to FIG. 5. The fuze 6 is armed and can be fired on impact or by a time setting.

The invention claimed is:

1. A safety and arming unit for a fuze of a projectile, comprising:

a firing means disposed to transfer a firing energy thereof to another firing means;

a barrier for selectively interrupting the transfer of the firing energy; and a safety means disposed to lock said barrier in a locking state and to unlock said barrier in dependence on an apogee parameter, the apogee parameter identifying a flight of the projectile through an apogee of a projectile trajectory, wherein said safety means unlock said barrier only when the apogee parameter indicates that the projectile is flying through or has flown through the apogee of the projectile trajectory.

2. The safety and arming unit according to claim 1, wherein the apogee parameter is a purely physical arming parameter.

3. The safety and arming unit according to claim 1, wherein the apogee parameter is a force.

4. The safety and arming unit according to claim 1, wherein said safety means is configured for mechanical sampling of the apogee parameter.

5. The safety and arming unit according to claim 1, wherein said safety means comprises a locking means which causes an unlocking action by changing a position thereof in the fuze on passing through the apogee.

6. The safety and arming unit according to claim 5, wherein said locking means has a defined safety position wherein said locking means mechanically blocks an unlocking action.

7. The safety and arming unit according to claim 5, wherein said locking means is disposed to change a position by way of an inertia thereof.

8. The safety and arming unit according to claim 5, wherein, by changing a position thereof, said locking means unblocks an unlocking space into which part of a lock can be inserted for effecting the unlocking action.

9. The safety and arming unit according to claim 1, wherein said safety means comprises a magnet disposed to change a position thereof in the fuze and to thereby cause an unlocking action as the projectile passes through the apogee.

10. The safety and arming unit according to claim 1, wherein said safety means is configured to require preliminary unlocking in dependence on an arming parameter different from the apogee parameter, before said safety means is unlocked when the apogee parameter is satisfied.

11. The safety and arming unit according to claim 1, which comprises a further safety means disposed to unblock said safety means for unlocking, said further safety means effecting the unblocking when the projectile is being launched.

12. The safety and arming unit according to claim 1, wherein said barrier is a rotor and said safety means is disposed to lock said rotor.

13. The safety and arming unit according to claim 1, wherein the apogee parameter is a change in a direction of the projectile.

14. The safety and arming unit according to claim 1, wherein the apogee parameter is a lateral acceleration component of the fuze.

15. The safety and arming unit according to claim 1, wherein the apogee parameter is satisfied when a longitudinal acceleration component of the fuze reaches a minimum.

16. The safety and arming unit according to claim 1, wherein the apogee parameter is satisfied when a velocity of the projectile reaches a minimum.

17. The safety and arming unit according to claim 1, wherein the apogee parameter is a direction of the Earth's magnetic field relative to a fuze direction.

18. A safety and arming unit for a fuze of a projectile, comprising:

a firing means disposed to transfer a firing energy thereof to another firing means;

a barrier for selectively interrupting the transfer of the firing energy; and a safety means disposed to lock said barrier in a locking state and to unlock said barrier in dependence on an apogee parameter effected when the projectile flies through an apogee of a projectile trajectory;

said safety means including a locking means which causes an unlocking action by changing a position thereof in the fuze on passing through the apogee of the projectile trajectory, said locking means having a defined safety position wherein said locking means mechanically blocks an unlocking action.

19. The safety and arming unit according to claim 18, wherein said locking means is disposed to change a position by way of an inertia thereof.

* * * * *